US007624740B2

(12) United States Patent
Lipscomb et al.

(10) Patent No.: US 7,624,740 B2
(45) Date of Patent: Dec. 1, 2009

(54) CONTROLLED VENTILATION AIR CURING SYSTEM

(75) Inventors: Leonard W. Lipscomb, Mechanicsville, VA (US); John D. M. Bain, Midlothian, VA (US); Boris L. Kizzie, Hopewell, VA (US); Michael B. Maher, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 768 days.

(21) Appl. No.: 11/476,777

(22) Filed: Jun. 29, 2006

(65) Prior Publication Data

US 2007/0003899 A1 Jan. 4, 2007

Related U.S. Application Data

(60) Provisional application No. 60/695,540, filed on Jul. 1, 2005.

(51) Int. Cl.
*A24B 3/10* (2006.01)

(52) U.S. Cl. ..... 131/303; 432/500

(58) Field of Classification Search ..... 131/300, 131/302, 303; 34/233, 230, 235, 535, 256; 432/500

See application file for complete search history.

(56) References Cited

U.S. PATENT DOCUMENTS

| | | | |
|---|---|---|---|
| 2,528,982 | A | 11/1950 | Touton |
| 3,251,620 | A | 5/1966 | Hassler |
| 3,503,137 | A | 3/1970 | Wilson |
| 3,669,429 | A | 6/1972 | Dew |
| 3,937,227 | A | 2/1976 | Azumano |
| 4,021,928 | A | 5/1977 | Johnson |
| 4,192,323 | A | 3/1980 | Horne |
| 4,470,422 | A | 9/1984 | Joubert et al. |
| 4,737,103 | A | 4/1988 | Siccardi |
| 4,850,264 | A | 7/1989 | Kiser |
| 6,786,220 | B2 | 9/2004 | Bokelman et al. |

FOREIGN PATENT DOCUMENTS

| | | |
|---|---|---|
| CA | 557858 | 5/1958 |
| WO | 2004/049836 A | 7/2004 |

OTHER PUBLICATIONS

International Preliminary Report on Patentability dated Jan. 10, 2008 for PCT/IB2006/003494.
Partial International Search Report for PCT/IB2006/003494 dated May 7, 2007.
International Search Report and Written Opinion for PCT/IB2006/003494 dated Aug. 23, 2007.

*Primary Examiner*—Carlos Lopez
(74) *Attorney, Agent, or Firm*—Buchanan Ingersoll & Rooney PC

(57) ABSTRACT

A tobacco curing enclosure includes roof vents, sidewall fan assemblies with heaters, a humidity augmentation system, and internal air circulation devices. Internal temperature and humidity monitors are connected with a control system for the fans, vents, heaters, humidity augmentation system and air circulation devices. The control system in conjunction with the enclosure allows humidity inside the enclosure to be controlled according to a predetermined schedule despite the ambient weather conditions, thereby enhancing the quality of cured tobacco.

21 Claims, 2 Drawing Sheets

CONTROLLED VENTILATION AIR CURING SYSTEM

CROSS-REFERENCE TO RELATED APPLICATION

This application claims priority under 35 U.S.C. §119 to U.S. Provisional Application No. 60/695,540 entitled CONTROLLED VENTILATION AIR CURING SYSTEM, filed Jul. 1, 2005, the entire content of which is hereby incorporated by reference.

FIELD OF THE DISCLOSURE

Broadly, this disclosure relates to systems and apparatus for air curing tobacco. More particularly, it concerns a modular system for air curing tobacco having controlled ventilation, thermal conditioning, as well as remote monitoring and control access.

SUMMARY

A tobacco curing system useful for air-curing tobacco includes at least one enclosure module in which tobacco plants can be air cured. The enclosure has air and moisture handling equipment. For example, the enclosure preferably may include an internal air circulation system operable to provide generally uniform temperature and humidity conditions throughout the enclosure. At least one roof vent may preferably be provided for venting air inside the enclosure to the atmosphere when air in the enclosure becomes overheated, too moist, or subject to air exchange. The enclosure preferably includes a high-volumetric-flow-rate, reversible sidewall fan having selective communication with air outside the enclosure. The sidewall fan is operable to deliver ambient air into the enclosure when internal temperature and humidity conditions can be adjusted with air at ambient conditions, and is operable to forcibly exhaust air from the enclosure to the atmosphere when temperature and/or humidity conditions inside the enclosure cannot be adjusted by ingestion of ambient air. A humidity atmosphere when temperature and/or humidity conditions inside the enclosure cannot be adjusted by ingestion of ambient air. A humidity augmentation system may also be provided in the enclosure to distribute added moisture in the enclosure so as to adjust air humidity inside the enclosure. The humidity augmentation may also function to adjust temperature of air in the enclosure when a hot fluid such as steam is introduced to raise humidity. For those times when the ambient temperature is too low or ambient humidity is too high, an air heating system for the sidewall fan may be provided.

Temperature and humidity sensors can also be provided both inside and outside of the enclosure. A programmable monitoring and control system receives input from the temperature and humidity sensors and is operably connected with the sidewall fan, the air circulation system, the roof vent, the humidity augmentation system, and the air heating system. The programmable monitoring and control system provides controlling output to at least one of the sidewall fan, the air circulation system, the roof vent, the humidity augmentation system, and the air heating system to regulate humidity and temperature in the enclosure according to a predetermined schedule. The programmable monitoring and control system preferably includes a local monitoring station and a remote monitoring station, both of which are capable of manual intervention to adjust air and moisture handling equipment.

According to another aspect of the disclosure, a method for air curing tobacco includes hanging tobacco in an enclosure having at least one roof vent, at least one circulation fan located in an upper portion of the enclosure, at least one side wall fan in the enclosure communicating with air outside the enclosure, a humidity augmentation system operable to distribute moisture in the enclosure, an air heating system communicating with the reversible sidewall fan, an internal sensor arrangement for monitoring temperature and humidity in the enclosure, an external sensor arrangement for monitoring temperature and humidity outside the enclosure, and a monitoring system. The method includes the steps of remotely monitoring the internal and external sensors so that humidity in the enclosure follows a predetermined schedule. The method also includes the steps of remotely adjusting at least one of the roof vent, the circulation fan, the side wall fan, the humidity augmentation system, and the air heating system to maintain humidity within the schedule.

To accommodate multiple tobacco harvests and/or harvests exceeding the capacity of the enclosure, multiple enclosures having the features described above may be controlled by the monitoring system. The curing process may, therefore, monitor multiple enclosures remotely to assure that humidity in each enclosure conforms to a corresponding predetermined schedule. Moreover, the curing process may include the step of remotely adjusting roof vents, circulation fans, side wall fans, humidity augmentation systems, and air heating systems to maintain humidity in the various enclosures according to corresponding schedules for the respective enclosures.

BRIEF DESCRIPTION OF THE DRAWINGS

The accompanying drawings schematically depict a controlled ventilation tobacco curing system. In the accompanying drawings, like reference numerals are applied to like elements.

DETAILED DESCRIPTION

Figure 1:
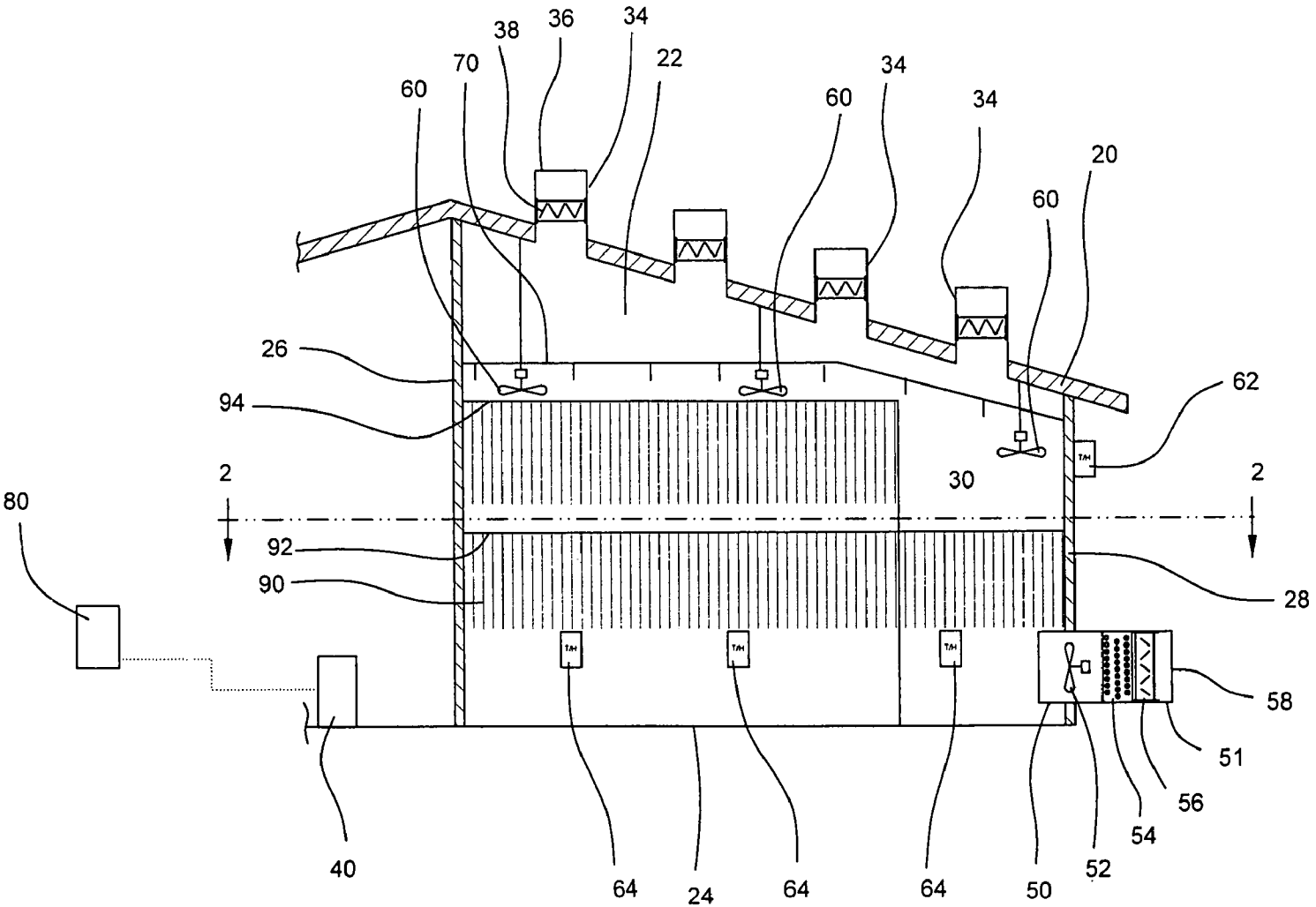
FIG. 1 is a cross-sectional view of a ventilation enclosure according to one embodiment of the disclosure.

It is well-known that following harvest, tobacco needs to be cured before it is marketed or used for manufacture of cigarettes or other smokable articles. Typically, optimal tobacco curing occurs in air-curing barns and follows a predetermined curing schedule of humidity variation over time. The curing period may last on the order of 50 days. Such tobacco curing barns protect the harvested tobacco from environmental precipitation, such as rain, but also permit use of ambient variations of humidity, temperature, and wind to modify conditions inside the barn. Devices such as openable/closable louvers in side walls of the barn, and roof ventilation controls have been used to implement those ambient conditions to adjust humidity conditions inside the barn.

The optimal schedule for tobacco curing in conventional barns needs to account for, and accommodate, weather variables, barn conditions, and tobacco conditions. Weather variables include, for example, temperature, humidity, precipitation (rain), wind speed, wind direction, and daily diurnal variability of those variables. Barn conditions include internal temperature, internal humidity, and air movement or circulation speed. Tobacco conditions which affect curing include tobacco ripeness at harvest, field wilting of harvested tobacco, moisture content at the beginning of tobacco curing, density of packing tobacco in the curing barn, and the tobacco variety being cured. Various Burley varieties of tobacco are typically air cured in barns.

Centralized tobacco curing is an alternative to conventional Burley tobacco curing. With centralized curing, crops from different fields are cured simultaneously in structures that are considerably larger than traditional Burley tobacco barns. As barns get larger in physical dimensions and volume to accommodate large crops, and as freshly harvested tobacco gets packed more tightly into the tobacco barns, gradients and variations in humidity and temperature occur within the tobacco barn. The non-uniform conditions resulting from such humidity and temperature gradients and variations can affect the tobacco curing process in undesirable ways. For example, smaller leaves and/or leaves near the outside of the storage area in the tobacco barn may dry out too quickly, or more quickly than larger leaves and/or leaves in the center of the storage area. Consequently, as tobacco barns increase in size, obtaining optimal curing for all the tobacco in the barn becomes increasingly difficult.

Centralized tobacco curing also introduces other variables that affect tobacco curing. For example, where tobacco from several fields, or farms, is cured simultaneously, the time to fill the curing structure becomes a variable because the tobacco first loaded into the structure may have begun the curing process a matter of days before the tobacco last into the structure begins the curing process. The uniformity, or non-uniformity, of air distribution and recirculation within the structure also become factors as a result of the larger scale of the structure as compared with traditional tobacco barns. With higher packing densities, introduction of sufficient oxygen coupled with removal of off-gases becomes a factor too. Thus, the fresh-air change-out frequency and control of fresh inlet airflow are additional factors affecting curing. Prolonged periods of adverse curing weather, such as hot-and-dry periods or cold-and-wet periods, require accommodation, too. As the curing period approaches its end point, the appropriate humidity and equilibration time represent further variables. Other variables affecting the tobacco curing process will likely also occur to those skilled in the art.

From the foregoing discussion, it will be seen that the variables discussed may impact the rate of moisture removal from tobacco plants during curing and may directly influence curing and drying reactions within the tobacco plants as well as resulting quality of cured Burley tobacco.

In a first embodiment (see FIG. 1), a large structure 20 for curing tobacco, may, for example, be a large tobacco barn or even a warehouse. The structure 20 includes at least one module having an enclosure 22, and preferably more than one such module and associated enclosure 22. With more than one enclosure, tobacco from a large field, or several smaller fields, can be hung in the enclosure so that the curing process can proceed without unnecessary delay. Then, after harvest of tobacco from other fields, another enclosure is loaded with that later-harvested tobacco and curing can proceed. Furthermore, if the tobacco in different growing areas serviced by the large structure 20 has different initial moisture content, then the enclosures may be packed according to the initial moisture levels of the harvested tobacco.

Each enclosure 22 has a floor 24, a plurality of walls 26, 28, 30, and a roof or ceiling 32. Note that a fourth wall is not visible in FIG. 1. The floor 24, walls 26, 28, 30, and roof 32 cooperate to define a fully enclosed structure. One or more of the walls, 26, 28, 30 and the roof 32 may also be walls of the structure 20. It is also contemplated that surfaces defining the enclosure may also be separate from corresponding external surfaces of the structure 20 so that the enclosure 22 is contained entirely within the envelope of the structure 20. With such a construction, the enclosure 22 does not have the same environmental temperature variations as the structure 20. Conversely, where one or more surfaces of the structure 20 also function as corresponding surfaces of the enclosure 22, then at least those dual-function surfaces of the enclosure 22 experience the same environmental temperature variations as those of the structure 20.

To load freshly harvested uncured tobacco into the enclosure 22, at least one wall includes an openable and closable opening (not shown) sufficiently large to accommodate the ingress and egress of equipment moving harvested tobacco into the enclosure 22. In addition, that opening functions to allow equipment to remove cured tobacco from the enclosure 22 after the curing process has been completed.

Unlike tobacco barns with large sidewall openings that merely allow air to circulate in an uncontrolled manner, the enclosure of this embodiment not only allows use of environmental conditions but also mechanically circulates air, and exchanges air inside the enclosure with air outside the enclosure so that internal humidity follows the predetermined schedule. Moreover, air is mechanically circulated inside the enclosure 22 to promote uniform curing of the tobacco in each module. While the predetermined curing schedule of all modules may be the same, the predetermined curing schedules may be coordinated with individual modules and different for different modules.

A plurality of roof vents 34 establishes fluid communication between the air inside the enclosure and ambient air. Thus, each roof vent 34 is open to the inside of the enclosure 22, but may include a suitable cover 36 to shield the inside of the enclosure 22 from environmental precipitation. Each roof vent 34 also includes movable dampers or louvers 38 extending across the roof vent and operable to open and close fluid communication through the corresponding roof vent 34. The movable louvers 38 preferably have a remotely operated drive system to open and close them in addition to a manual control. The louvers 38 typically move between a fully closed position and a preselected percentage open position. The louvers 38 may also be under the control of a programmable monitoring and computer control system 40 located outside the enclosure 22. For operation under the computer control, the drive system for the louvers 38 may be hard-wired to the programmable monitoring and control system 40 or a wireless signal transmission system can be employed. When open, these louvers 38 function as fresh air intakes during typical operation where the enclosure interior communicates with ambient air. In addition, when open, the louvers 38 may function as exhaust openings when ambient air enters the enclosure 22 in other ways.

For example, air may be introduced into the enclosure 22 through a plurality of sidewall fan assemblies 50. Each sidewall fan assembly 50 may include a duct 51 extending generally horizontally through a corresponding opening in one of the sidewalls 28 at a position near the bottom or floor 24 of the enclosure 22. Such a location for the side wall fans 50 provides relatively unobstructed access to the lower portion of the tobacco placed in the enclosure 22 for curing. Each sidewall fan assembly 50 may, for example, have a volumetric flow rate in the range of 20,000 cubic feet per minute (cfm) or less to about 50,000 cfm, preferably about 40,000 cfm. Preferably, the number and volumetric flow rate of the sidewall fan assemblies 50 are selected so that the ratio, Q/A, of sidewall fan volumetric flow rate in cfm, Q, to the area in square feet of the enclosure floor, A, lies within the range of about 3 cfm/ft$^2$ about 8 cfm/ft$^2$, more preferably in the range of about 3.5 cfm/ft$^2$ to about 7 cfm/ft$^2$, and most preferably in the range of about 3.5 cfm/ft$^2$ to about 4 cfm/ft$^2$. The most preferred range for the ratio Q/A gives a reasonable balance between the capital cost of the sidewall fan assemblies and the rate at which air inside the enclosure can be exchanged with the environment. For a enclosure 22 having a floor area of about 23,000 sq. ft. at least two sidewall fan assemblies 50 may be used, and as many as about four such assemblies 50.

Each sidewall fan assembly includes a motor-driven, remotely controlled, reversible axial-flow fan 52. Each fan 52 can be hardwired to the programmable monitoring and control system 40 or connected to the programmable monitoring and control system 40 by a wireless connection. Either way, the programmable monitoring and control system 40 is operable to control the fan 52 as to whether it is on or off, the duration of its operation, and whether it draws air into the enclosure 22 or exhausts air from the enclosure 22. In the preferred embodiment, the sidewall fan 52 is not modulated; however, modulated fans are nevertheless within the scope of this embodiment.

Each sidewall fan assembly 50 also includes an air heating system 54 positioned between the fan 52 and the outside end 58 of the assembly 50. The heating system 54 may include a steam heater unit driven from a source of steam or other readily available heating fluid. For example, the structure 20 may include a packaged steam boiler capable of generating, for example, steam at a pressure of about 125 psi. Such a steam boiler would be started manually when the need for steam exists. When the boiler is operating, the heating system 54 is also under the control of the programmable monitoring and control system 40. The heating system 54 includes a control assembly which is connected to the programmable monitoring and control system 40 either by hardwiring or by wireless connection. Instead of a steam driven heater unit, an electrical resistive heater unit may be employed.

In periods where the ambient temperature is too low, the heating assembly 54 may be operated to warm outside air before it reaches the fan 52 for delivery to the inside of the enclosure 22. Moreover, during periods of adverse weather such as periods of very high external humidity or rain, the incoming air can be heated so that its relative humidity is lowered. The heating system 54 thus aids the curing process by helping to prevent barn rot in early stages of the curing cycle, or to accelerate stem and stalk drying during later parts of the curing cycle.

Each sidewall fan assembly 50 further includes a set of movable dampers or louvers 56 extending across the duct 51 and operable to open and close fluid communication through the corresponding assembly 50. The movable louvers 56 are capable of manual operation and preferably include a remotely operated drive system to open and close them—preferably under the control of the programmable monitoring and control system 40. For remote control purposes, the drive system may be hard-wired to the programmable monitoring and control system 40, or a wireless signal transmission system can be employed. During manual operation, the louvers 56 are arranged to fully open when the associated fan 52 is on, and to fully close when the associated fan 52 is off.

When ambient weather conditions permit, one or more of the fans 52 can be turned off and the louvers 56 of the sidewall fan assemblies may be opened along with the louvers 38 of the roof vents 34 so that convection air currents allow fresh air to enter through one of the sidewall fan assemblies 50 and the roof vents 34 and to exhaust through the other of the sidewall fan assemblies 50 and the roof vents 34. When ambient weather conditions do not promote a sufficient convection air flow through the enclosure, the fan 52 of each sidewall fan assembly 50 can be operated to draw sufficient air into the enclosure 22, while air being replaced flows out of the roof vents 34. The sidewall fan assemblies 50 can be operated at any time to provide a desired, predetermined rate of air exchange through the enclosure 22.

Disposed inside the enclosure 22, near the upper portion thereof, is a plurality of ceiling fans 60. Each ceiling fan 60 may, for example, be suspended from the roof 32 in a suitable manner. Each ceiling fan 60 preferably includes a control that is either hardwired to the programmable monitoring and control system 40 or which is connected to the programmable monitoring and control system 40 through a wireless connection. Thus, each ceiling fan 60 is under the control of the programmable monitoring and control system 40. These ceiling fans 60 are reversible, and may also be variable speed if desired. Moreover, these ceiling fans 60 function to maintain a generally uniform circulation of air inside the enclosure during curing. That circulation may be used to push air down through the structure, and may also be used to pull air up through the structure for exhaust through the roof vents.

The ceiling fans 60 are especially useful to generate internal air circulation when ambient weather conditions are adverse to the predetermined curing schedule. The circulation rate is selected such that temperature and humidity conditions are substantially uniform throughout the interior of the enclosure 22. Each ceiling fan 60 may, for example, have a volumetric flow rate in the range of 20,000 cfm to about 55,000 cfm, and preferably about 46,000 cfm. The number and volumetric flow capacity of the ceiling fans are preferably selected so that the ratio Q/A preferably lies in the range of about 20 cfm/ft$^2$ to about 35 cfm/ft$^2$, more preferably in the range of about 20 cfm/ft$^2$ to about 30 cfm/ft$^2$, and most preferably in the range of about 25 cfm/ft$^2$ to about 30 cfm/ft$^2$. The most preferred range is effective to maintain substantial uniformity of temperature and humidity and to promote adequate mixing of air within the enclosure 22. For an enclosure having a floor area of about 23,000 sq. ft., approximately 15 ceiling fans 60 would be used.

At least one outdoor temperature and humidity sensor arrangement 62 may be provided outside the enclosure 22. As desired, the sensor arrangement 62 may include separate temperature and humidity sensors, or a combined temperature and humidity sensor device. Preferably, this external temperature and humidity sensor arrangement 62 may be located in an aspirating cabinet located on an upper portion of a sidewall 28 of the structure 20 at a position under the roof overhang. This location protects the humidity sensor 62 from atmospheric precipitation. The external sensor 62 is connected to the programmable monitoring and control system 40 either with a wireless connection or by hardwiring.

At various locations on the interior walls of the enclosure 22, interior temperature and humidity sensor arrangements 64 are provided. As with the external sensor arrangement 62, the internal sensor arrangements 64 may include separate temperature and humidity sensors or a combined temperature and humidity sensor device. These interior sensor arrangements 64 may also be located in corresponding aspirating cabinets located around the enclosure 22 so that variations in temperature and humidity throughout the interior volume of the enclosure can be detected and monitored. Each internal sensor arrangement 64 is connected to the programmable monitoring and control system 40 either with a wireless connection or by hardwiring.

Located in the enclosure 22 at a position above the uppermost storage position for tobacco is a humidity augmentation system 70. The humidity augmentation system 70 is operably connected with a source of moisture. For example, the system 70 may include a piping system fashioned from ¾" stainless steel pipe with a plurality of nozzles, e.g., ⅛" orifices spaced at intervals of about 6 feet along its exposed length inside the enclosure 22. Various sources of moisture can be envisioned. A preferable moisture source is steam, namely the packaged steam boiler discussed above. Alternatively, however, the moisture source may be water under sufficient pressure that when water escapes from the nozzles it is atomized into fine droplets that evaporate into the air inside the enclosure 22 before the droplets can fall on the curing tobacco. As with other systems in the enclosure, the humidity augmentation system 70 preferably includes a control connected to the programmable monitoring and control system 40 either with a wireless connection of by hardwiring. The humidity augmentation system can be used as appropriate to humidify air in the enclosure 22 during long periods of high external temperature and low humidity so as to substantially prevent or reduce flashing and/or over drying of tobacco early in the curing cycle.

From the foregoing description, it will be seen that the ventilation system of this embodiment includes a monitoring and control system 40 that includes a computer. Moreover, that monitoring and control system 40 is connected with the internal and external temperature and humidity monitors 62, 64 to assess whether the humidity in various internal regions of the enclosure 22 conform to the predetermined schedule for tobacco curing. Further, the monitoring system is connected with the roof vents 34, the ceiling fans 60, the humidity augmentation system 70, the sidewall fans 52, the sidewall air heating system 43, the sidewall fan louvers 56, and the roof vent louvers 38 so as to operably control each of them to maintain substantially uniform conditions throughout the interior of the enclosure 22.

The monitoring and control system continuously monitors and records the monitored information on each of the ceiling fans 60, each of the sidewall fans 52, the roof vent louvers 38, the sidewall fan louvers 56, the humidity augmentation system 70, and the air heating systems 54 of the sidewall fan assemblies 50, as well as the internal temperature and humidity at each of the internal sensor arrangements 64, and the external temperature and humidity at the external sensors 62. The resulting records allow confirmation that the predetermined curing schedule has been followed, identification of the actual curing schedule that occurred, and assessment of the frequency and use of the air and moisture manipulating equipment of the enclosure. Moreover, the monitoring and control system also allows those various devices to be used to adjust the humidity and or temperature level within the enclosure 22 as may be desired to conform to the predetermined curing schedule.

The computer is part of a programmable control system that uses the input from the sensors to start and stop the ventilation system automatically in order to maintain specified humidity levels during the curing cycle. Typically, the programmable monitoring and control system 40 is located in another part of the structure 20, such as an office or control room; however it is within the contemplation of this disclosure that the programmable monitoring and control system 40 could be located outside the structure 20 in an adjacent, or nearby site or location. Regardless of where the local programmable monitoring and control system 40 is located, a remote monitoring system 80 which includes its own computer can communicate with the local monitoring system. The remote monitoring system 80 can be connected to the local monitoring system with a wireless connection, or with a hardwired connection such as a telephone connection, a DSL connection, or other high-speed internet connection. Moreover, the remote monitoring system 80 may reside on or be downloadable onto a desk-top or a portable computer, such as a laptop or hand-held computer.

The local monitoring system accepts control commands from the remote monitoring system, which commands can selectively adjust and/or control operation of any one or more of the roof vents 34, the roof vent louvers 36, the ceiling fans 60, the humidity augmentation system 70, the sidewall fans 42, the air heating system 54, and the sidewall louvers 56. Moreover, the local monitoring system may be programmed such that control commands from the remote monitoring system override inconsistent or contrary command instructions from the local monitoring system. At the end of the curing process, the monitoring system may also be used to adjust the humidity of the cured tobacco in the enclosure 22 in preparation for marketing.

Figure 2:
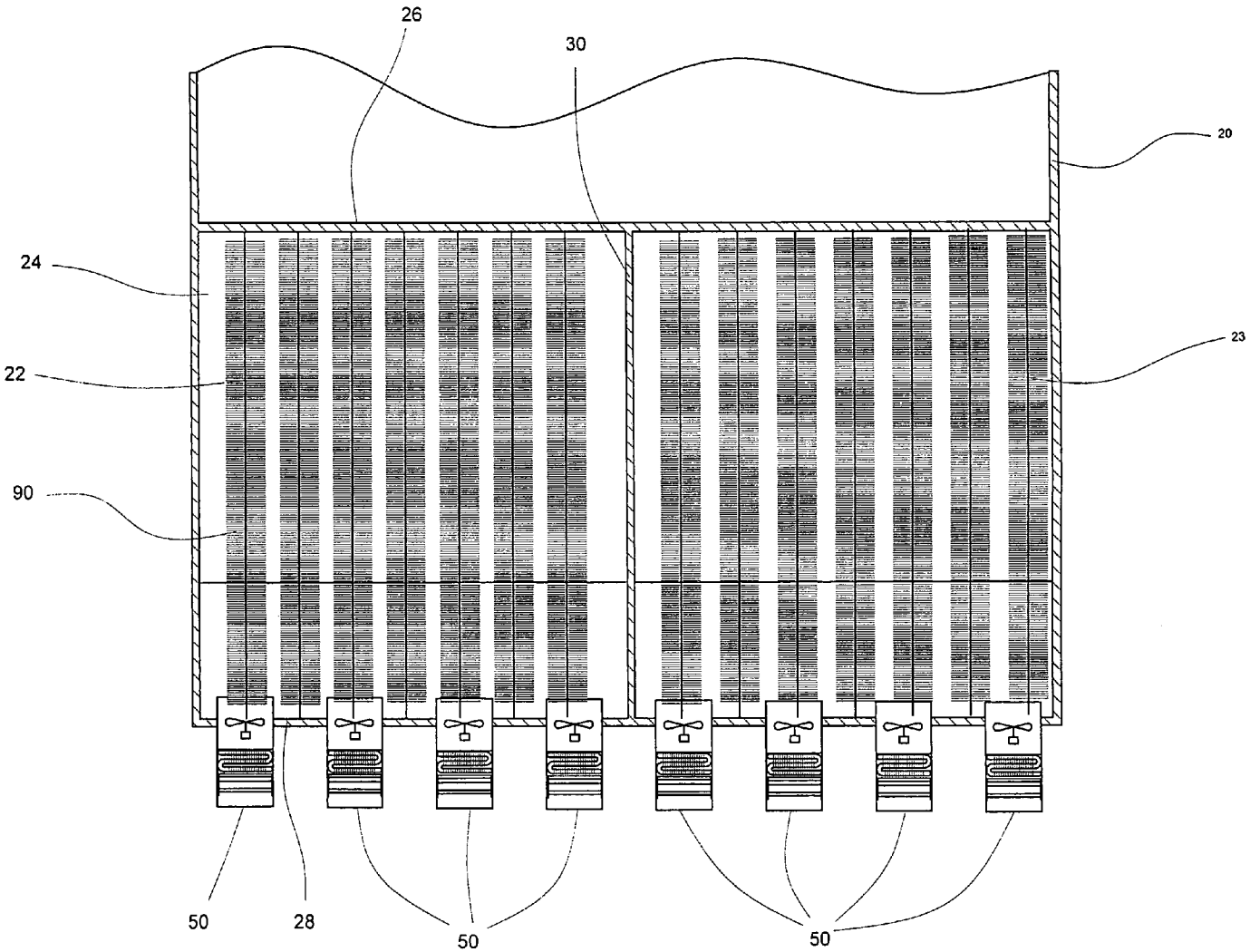
FIG. 2 is a cross-sectional view taken along the line 2-2 of FIG. 1.

As best seen in FIG. 2, the structure 20 may include two or more enclosures 22, 23 for curing tobacco. Where multiple enclosures are available, the harvested tobacco from different fields or different farms may be loaded into separate enclosures for curing purposes.

Operation of the curing enclosure described above is well-suited for air curing of Burley tobacco grown in various regions of the United States. The curing enclosure described above is operative to supplement known conventional practices for Burley tobacco curing. Those known conventional practices seek to achieve the best possible cured tobacco quality by taking into account weather conditions during the curing period and adjusting the curing conditions as needed to attain the best possible cured tobacco consistent with the customer's ultimate requirements.

In use, harvested tobacco (typically the Burley variety) is delivered to the central curing enclosure 22 (see FIG. 2). For curing, the butt end of the tobacco plant may be speared with a lance, with each lance holding about 5 or 6 individual plants. Sticks holding tobacco plants 90 are hung on racks inside the enclosure 22. Where the vertical height of the enclosure permits, the sticks holding tobacco plants 90 may be arranged in one, two, or more vertical tiers 92, 94 (see FIG. 1).

The enclosure is then closed and the curing process begins according to the predetermined curing schedule. During the curing process, outside temperature and humidity, and internal temperature and humidity are continuously monitored and recorded by the local monitoring system. In addition, local manual adjustment and remote adjustments of fresh air and recirculation air flow rates are continuously monitored and recorded by the local monitoring system.

Preferably, the local monitoring system includes a motor control center having, for example, Allen Bradley type controllers, or equivalents, for the individual fans, louvers, heating systems, and humidification system. Each of those controllers is coupled with a corresponding remote user interface control so that remote operation and control can be effected.

The local monitoring system issues an alarm signal at the motor control center when any one of several conditions exist, namely: (i) when the enclosure internal humidity exceeds a predetermined high value; (ii) when the external humidity exceeds a predetermined high value; (iii) when the enclosure internal humidity falls below a predetermined low value; and (iv) when the external humidity falls below a predetermined low value. That alarm signal may be audible, visual, or both.

The local monitoring and control system preferably has several pre-programmed, time-limited preset operations for the motor control center. One of those preset operations is the "barn off" condition. In this preset operation, the controllable actuators for fans, louvers, humidity augmentation, and air heating are disabled. This preset condition is used, for example, when manual operation of the curing enclosure 22 is desired.

Another preset operation is the "barn closed" condition. In this preset operation, the roof louvers 38, and the sidewall fan louvers 56 are closed, and the enclosure 22 can be operated to internally circulate air and/or to humidify the internally circulating air. This preset condition is useful when the ambient conditions external to the enclosure 22 can adversely affect the curing process such that humidity is too high, humidity is too low, precipitation is occurring, or when air temperature is too low.

Another preset operation is the "barn vent" condition. In this condition, the roof louvers 38, and the sidewall fan louvers 56 are opened, and the enclosure 22 can be operated with free communication to ambient air conditions outside the enclosure 22. This preset operation may be used, for example, when the temperature and humidity conditions of ambient air are appropriate for the then current stage of the curing tobacco according to the predetermined schedule.

Normal control inputs to cure tobacco according to the curing predetermined schedule are accessible through the programmable monitoring and control system and related operating software. The software provides input fields in which desired settings for the controllable equipment in the enclosure 22 can be set. For example, on and off settings for each of the sidewall mounted fans 52 are provided, with the sidewall fan louvers 56 being set to automatically open when the associated fan 52 switches on, and to automatically close when the associated fan 52 switches off. Input fields for desired on and off settings of the ceiling fans 60 are also provided. In this connection the ceiling fans 60 may be controlled either individually or in groups with several ceiling fans being assigned to each such group. While the ceiling fans 60 may operate in forward and reverse directions, the settings for forward and reverse operation are preferably controlled manually. Input fields are also provided for open and closed operation of the roof louvers 38. In the closed position, the actuator moves the louvers 38 to a fully closed position; whereas, in the open position, the actuator moves the louvers 38 to a preset open position, which may be fully open if so desired. In addition to the foregoing controls, inputs are provided for on and off conditions of the humidity augmentation system 70 as well as for the air heaters 54 of the sidewall fan assemblies 50.

The flow rate of outside air introduced into the enclosure is controlled in fixed increments corresponding to the number of sidewall fans 52 that are running.

During curing, the enclosure 22 can be operated to lower internal humidity or to raise internal humidity, despite and independently of ambient weather conditions. For example, to raise internal humidity when the external humidity is lower, the humidity augmentation system may be activated so that steam is introduced into the enclosure 22 and atomized to directly and efficiently raise the internal humidity. To raise internal humidity when the external humidity is higher, the sidewall fan assemblies 50 may be operated to draw in external air while allowing air inside the enclosure 22 to escape and be exhausted through the roof vents 34. Alternatively, the sidewall fan assemblies 50 may be selectively operated to suck air out of the enclosure 22 while external air enters through the roof vents 34. To lower internal humidity when the external humidity is lower, the sidewall fan assemblies 50 may be operated to draw in the external air while allowing air inside the enclosure 22 to escape through the roof vents 34. Alternatively, the sidewall fan assemblies 50 may be operated to suck air out of the enclosure 22 while fresh external air enters through the roof vents 34. To lower internal humidity when the external humidity is higher, the heating systems 54 of the sidewall fan assemblies 50 may be operated to heat incoming air that is then delivered to the enclosure interior. By heating the external air its relative humidity is reduced.

The above-described system and steps can be used in conjunction with other procedures as part of a total tobacco management system. As an example, the water load going into the curing facility can be significantly influenced by choosing whether to first subject the tobacco to a pre-wilting step of approximately 3 to 7 days duration prior to loading the tobacco into the curing facility. Furthermore, during a cool-and-damp curing season, the heating systems 54 may be employed in the curing enclosure to raise the internal temperature to promote curing.

The methods and apparatus described above allow the tobacco to be brought into a desired condition quickly at the end of a curing period, thereby providing labor savings for the farmer or convenience when relying on the use of manual labor. The above-described method steps and facility may also allow a tobacco purchaser to obtain cured tobacco earlier in the season and process it so as to minimize microbial degradation.

The centralized curing possible with the enclosure described above presents numerous advantages as compared with conventional curing structures. For example, the rate of barn-air exchange to the environment now becomes a controllable variable. More specifically, the sidewall fan assemblies 50 can operate to generate a desired barn-air exchange rate regardless of whether ambient wind velocity and direction are adequate to do so.

Further, the high-volumetric-flow-rate ceiling fans stimulate substantially uniform distribution and circulation of air throughout the interior of the curing enclosure. That circulation and distribution of air exposes tobacco throughout the enclosure to substantially uniform humidity and air temperature. Again, these aspects are available regardless of the ambient air conditions, including wind velocity, direction, humidity, and temperature.

In the tobacco curing process, certain off-gases occur. Removal of those off-gases improves the quality of cured tobacco. Quality may also be enhanced when fresh oxygen is available to the curing tobacco. The curing enclosure described herein allows such off-gases to be removed at the discretion of the operator, rather than at the whim of nature. Likewise, fresh oxygen can be admitted to the curing process as desired via introduction and circulation of ambient air—again without regard to the vagaries of nature.

Furthermore, prolonged periods of adverse weather often occur during a tobacco curing cycle that may last, for example, for 50 days. Typical adverse weather patterns include long periods of rain, long periods of high temperature accompanied by low humidity, long periods of excessively high humidity, periods of very cold weather, and the like. The tobacco during enclosure herein described obviates such adverse weather through the circulation, heating, and humidification systems that are part of the enclosure. Thus, tobacco curing can proceed with significant repeatability to attain the best quality cured tobacco.

As the time for marketing cured tobacco approaches, the moisture level of the cured tobacco may desirably be lowered. With conventional curing structures, such humidity takedown is a haphazard event subject to the whim of ambient weather conditions. However, with the enclosure herein described, the moisture level of the cured tobacco can be reliably taken down to a desired level optimized for marketability.

The enclosure has the added benefit that its operation, as well as control when required, can be monitored from either a nearby or a remote location. In this way, a plurality of enclosures at the same or widely separated sites can be monitored and/or controlled according to a desired curing schedule—regardless of when the freshly harvested tobacco first enters the curing enclosure.

At various locations in the foregoing description, numerical values are set out. Where those numerical values are introduced by "about", it is intended that the values be considered as target values that include actual values within 5% of the target value. At other locations in the foregoing description, the word "substantial" or "substantially" to modify other terms with the intent that variations of about 5% are within the meaning of the modified term.

It will now be apparent to those skilled in the art that this specification describes a new, useful, and nonobvious controlled ventilation curing system for tobacco. It will also be apparent to those skilled in the art that numerous modifications, variations, substitutes, and equivalents exist for various aspects of the invention that have been described in the detailed description above. Accordingly, it is expressly intended that all such modifications, variations, substitutions, and equivalents that fall within the spirit and scope of the invention, as defined by the appended claims, be embraced thereby.

What is claimed is:

1. A tobacco curing structure, comprising:

at least one air-curing module in which tobacco can be stored; having a top portion, a roof, sidewalls, and a floor; the roof, sidewalls, and floor defining an enclosure, the module including:

at least one ceiling fan adjacent the top portion of the module;

at least one reversible sidewall fan, located in a sidewall of the structure, and communicating with air outside the module;

at least one vent in the roof of the enclosure, communicating with air outside the module;

a humidity augmentation system in communication with the module, operable to distribute moisture in the module to adjust humidity of air in the module and/or to adjust temperature of air in the module;

an air heating system communicating with at least one reversible sidewall fan for adjusting temperature of air entering the module;

an internal sensor system for monitoring the temperature and humidity in at least one location in the module;

an external sensor system for monitoring the temperature and humidity in at least one location outside the module;

a monitoring system connected with the internal sensor system and the external sensor system, and operable to control operation of the at least one ceiling fan, the at least one vent, and the humidity augmentation system, and the air heating system so that air temperature and humidity in the module satisfy a predetermined schedule.

2. The tobacco curing structure of claim 1, wherein the floor has an area, the at least one ceiling fan has a nominal volumetric flow rate, and additional ceiling fans with corresponding nominal volumetric flow rates are provided so that ratio of volumetric flow rate to enclosure floor area lies in the range of about 3 cfm/ft$^2$ to about 8 cfm/ft$^2$.

3. The tobacco curing structure of claim 1, wherein the floor has an area, the at least one ceiling fan has a nominal volumetric flow rate, and additional ceiling fans with corresponding nominal volumetric flow rates are provided so that ratio of volumetric flow rate to enclosure floor area lies in the range of about 3.5 cfm/ft$^2$ to about 7 cfm/ft$^2$.

4. The tobacco curing structure of claim 1, wherein the floor has an area, the at least one ceiling fan has a nominal volumetric flow rate, and additional ceiling fans with corresponding nominal volumetric flow rates are provided so that ratio of volumetric flow rate to enclosure floor area lies in the range of about 3.5 cfm/ft$^2$ to about 4 cfm/ft$^2$.

5. The tobacco curing structure of claim 1, wherein the floor has an area, the at least one sidewall fan has a nominal volumetric flow rate, and one or more additional sidewall fans with corresponding nominal volumetric flow rates are provided so that the ratio of the sum of the volumetric flow rates from the sidewall fans to the enclosure floor area lies in the range of about 20 cfm/ft$^2$ to about 35 cfm/ft$^2$.

6. The tobacco curing structure of claim 1, wherein the floor has an area, the at least one sidewall fan has a nominal volumetric flow rate, and one or more additional sidewall fans with corresponding nominal volumetric flow rates are provided so that the ratio of the sum of the volumetric flow rates from the sidewall fans to the enclosure floor area lies in the range of about 20 cfm/ft$^2$ to about 30 cfm/ft$^2$.

7. The tobacco curing structure of claim 1, wherein the floor has an area, the at least one sidewall fan has a nominal volumetric flow rate, and one or more additional sidewall fans with corresponding nominal volumetric flow rates are provided so that the ratio of the sum of the volumetric flow rates from the sidewall fans to the enclosure floor area lies in the range of about 25 cfm/ft$^2$ to about 30 cfm/ft$^2$.

8. The tobacco curing structure of claim 1, wherein the monitoring system includes remote access so that off-site monitoring of temperature and humidity in the module can be sampled.

9. The tobacco curing structure of claim 8, wherein the remote access permits off-site control of the at least one ceiling fan, the at least one vent, the humidity augmentation system, and the air heating system.

10. The tobacco curing structure of claim 1, further including a second module having a top portion, a roof, sidewalls, and a floor, the roof, sidewalls, and floor defining a second enclosure, the second module including:

at least one ceiling fan adjacent the top portion of the second module;

at least one reversible sidewall fan, located in a sidewall of the second module, and communicating with air outside the second module;

at least one vent in the roof of the enclosure, communicating with air outside the second module;

a humidity augmentation system in communication with the second module, operable to distribute moisture in the second module to adjust humidity of air in the second module and/or to adjust temperature of air in the second module;

an air heating system communicating with at least one reversible sidewall fan for adjusting temperature of air entering the second module;

an internal sensor system for monitoring the temperature and humidity at at least one location in the second module;

the monitoring system is connected with the internal sensor system of the second module, and operable to control operation of the at least one ceiling fan of the second module, the at least one vent of the second module, the humidity augmentation system of the second module, and the air heating system of the second module so that air temperature and/or humidity in the second module satisfy a predetermined schedule independent of the predetermined schedule for the first module.

11. The tobacco curing structure of claim 1, wherein the humidity augmentation system comprises a steam distribution system.

12. The tobacco curing structure of claim 10, wherein the humidity augmentation system of the second module comprises a steam distribution system.

13. The tobacco curing structure of claim 1, wherein the tobacco curing structure is loaded with Burley tobacco for air curing.

14. Air curing tobacco using the tobacco curing structure of claim 1, comprising:

loading harvested tobacco into the enclosure;

controlling air flow and humidity conditions in the enclosure during air curing of the tobacco; and removing air-cured tobacco from the enclosure.

15. The air curing process of claim 14, wherein the controlling step includes substantially continuous monitoring of the humidity conditions in the enclosure; and adjusting humidity conditions in the enclosure so that those humidity conditions follow a predetermined air-curing schedule.

16. The air curing process of claim 14, including the further steps of loading harvested tobacco in a second enclosure;

controlling air flow and humidity conditions in the second enclosure during air curing of the tobacco; and removing air-cured tobacco from the second enclosure.

17. The air curing process of claim 16, wherein the controlling step includes substantially continuous monitoring of the humidity conditions in the second enclosure with a facility-wide monitoring system; and adjusting humidity conditions in the second enclosure so that humidity conditions in the second enclosure follow a second predetermined air-curing schedule.

18. The air curing process of claim 14, wherein the humidity conditions in the enclosure are monitored by a computer remote from the structure.

19. The air curing process of claim 17, wherein the humidity conditions in the second enclosure are monitored by a computer remote from the structure.

20. The air curing process of claim 17, wherein the humidity conditions in both the first and second enclosures are monitored by a computer remote from the structure.

21. The air curing process of claim 15, further including the steps of:

operating the enclosure using ambient air for one portion of the predetermined curing schedule; and operating the enclosure without free communication with ambient air for a second portion of the predetermined curing schedule.

* * * * *